US007917370B2

(12) United States Patent
Tsai et al.

(10) Patent No.: US 7,917,370 B2
(45) Date of Patent: Mar. 29, 2011

(54) CONFIGURABLE COMMON FILTERBANK PROCESSOR APPLICABLE FOR VARIOUS AUDIO STANDARDS AND PROCESSING METHOD THEREOF

(75) Inventors: Tsung-Han Tsai, Jhongli (TW); Chun-Nan Liu, Jhongli (TW); Hsing-Chuang Liu, Jhongli (TW)

(73) Assignee: National Central University, Taoyuan County (TW)

( * ) Notice: Subject to any disclaimer, the term of this patent is extended or adjusted under 35 U.S.C. 154(b) by 813 days.

(21) Appl. No.: 11/934,912

(22) Filed: Nov. 5, 2007

(65) Prior Publication Data

US 2009/0063160 A1 Mar. 5, 2009

(30) Foreign Application Priority Data

Sep. 4, 2007 (TW) ..... 96132905 A

(51) Int. Cl.
*G10L 19/00* (2006.01)

(52) U.S. Cl. ..... 704/500; 704/219; 381/22; 375/241

(58) Field of Classification Search ..... 704/219, 704/500; 381/22; 375/241
See application file for complete search history.

(56) References Cited

U.S. PATENT DOCUMENTS

| | | | | |
|---|---|---|---|---|
| 5,787,390 | A * | 7/1998 | Quinquis et al. | 704/219 |
| 6,807,524 | B1 * | 10/2004 | Bessette et al. | 704/200.1 |
| 7,788,107 | B2 * | 8/2010 | Oh et al. | 704/500 |
| 7,848,922 | B1 * | 12/2010 | Jabri et al. | 704/219 |
| 2007/0274383 | A1 * | 11/2007 | Yu et al. | 375/240.11 |

* cited by examiner

*Primary Examiner* — Daniel D Abebe
(74) *Attorney, Agent, or Firm* — Chun-Ming Shih

(57) ABSTRACT

A configurable common filterbank processor applicable for various audio standards and its processing method. Inverse modified discrete cosine transform (IMDCT) and window and overlap-add (WOA) decoding operations required by AC-3 and AAC, and IMDC, WOA, and matrixing decoding operations required by MP3 are divided into several different modes, and a quick algorithm is provided for expediting the operation of these modes, and a hardware architecture is designed universally for these modes, so that the hardware architecture can be applicable for the decoding operations of three different audio standards, respectively AC-3, AAC and MP3, to expand the scope of applicability of a decoder.

11 Claims, 7 Drawing Sheets

CONFIGURABLE COMMON FILTERBANK PROCESSOR APPLICABLE FOR VARIOUS AUDIO STANDARDS AND PROCESSING METHOD THEREOF

FIELD OF THE INVENTION

The present invention relates to a configurable common filterbank processor (CCFP) applicable for various audio standards and its processing method, and more particularly to an enhanced decoder architecture and a quick algorithm as well as an audio compression standard used for MP3, AC-3 and AAC to greatly improve the competitiveness of an audio decoder.

BACKGROUND OF THE INVENTION

In recent years, various different digital audio encoding standards are established to provide a high-quality audio compression. At present, the popular formats include MPEG-1 Layer3 (MP3), MPEG-2/4 Advanced Audio Coding (AAC), DOLBY AC-3, and WMA, and these audio encoding standards are used extensively in many areas, and each audio standard has its unique advantages. Apparently, there is no standard that will be able to replace all other standards in the coming few years.

Based on the consideration of different applications, there will be no particular audio compression standard capable of replacing all other audio compression standard specifications in the near future, and thus a design capable of supporting audio decoders of different standards not only enhances the application of a product, but also greatly improves its competitiveness.

Therefore, a decoder that only supports a single format can no longer satisfy consumer requirements anymore, and the trend is to provide a product with more functions. Designers and manufacturers try to design a single audio decoder that can handle various different audio formats. Further, low price and low power consumption are the major factors for integrating different audio compression standards of mobile phones and other portable products. Thus, it is a subject for manufacturers of audio related products, mobile phones and communication products to develop a decoder to support various different formats with a minimum hardware.

SUMMARY OF THE INVENTION

In view of the foregoing shortcomings of the prior art audio decoders that cannot be universally used for various compression standard specifications since there are many different audio encoding standards, the inventor of the present invention based on years of experience in the related industry to conduct extensive researches and experiments, and finally developed a configurable common filterbank processor applicable for various audio standards and its processing method in accordance with the present invention to overcome the shortcomings of the prior art.

The primary objective of the present invention is to provide a configurable common filterbank processor applicable for various audio standards and its processing method and develop a filterbank processor architecture that can be universally used in three different audio compression standards respectively MP3, AC-3 and AAC to greatly enhance the scope of application of an audio decoder.

A secondary objective of the present invention is to simplify a large amount of operations of an operation algorithm required for a decoding process and use a pipeline architecture in a hardware design to reduce the large amount of operations, the power consumption, and the hardware cost, so as to enhance the efficiency of a decoder.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

The invention relates to a configurable common filterbank processor applicable for various audio standards. In an audio processing procedure of AC-3, MP3 and ACC, the filterbank processor is a major component having the greatest number of operations that almost occupies 50% of the operations of the entire decoder (as shown in Table 1). Due to the large quantity of regular operations, it is an effective method of implementing the filterbank processor by hardware, and the configurable common filterbank processor applicable for various audio standards 1 can be considered as an accelerator or an auxiliary processor of a general processor. Taking the cost of hardware resources and the efficiency of applications into consideration, the present invention modifies the procedure of an audio decoding design and introduces a basic common procedure and designs a corresponding hardware architecture based on the common procedure. The present invention further provides a quick algorithm to reduce power consumption during the operations, and the hardware design also provides a full pipeline architecture to arrange different schedules according to the inputted control signal and planning for different configurations, while applying the aforementioned algorithm and architecture to the design of memory by a specific method, so as to reduce the using quantity of memories and enhance the overall system performance.

TABLE 1

Analysis of Computation Quantity of AC-3, MP3 and ACC Standards

| | AC-3 | MP3 | AAC |
|---|---|---|---|
| Filterbank Processor | 32.4% | 50.5% | 47.5% |
| Others | 67.6% | 49.5% | 52.5% |

Figure 1:
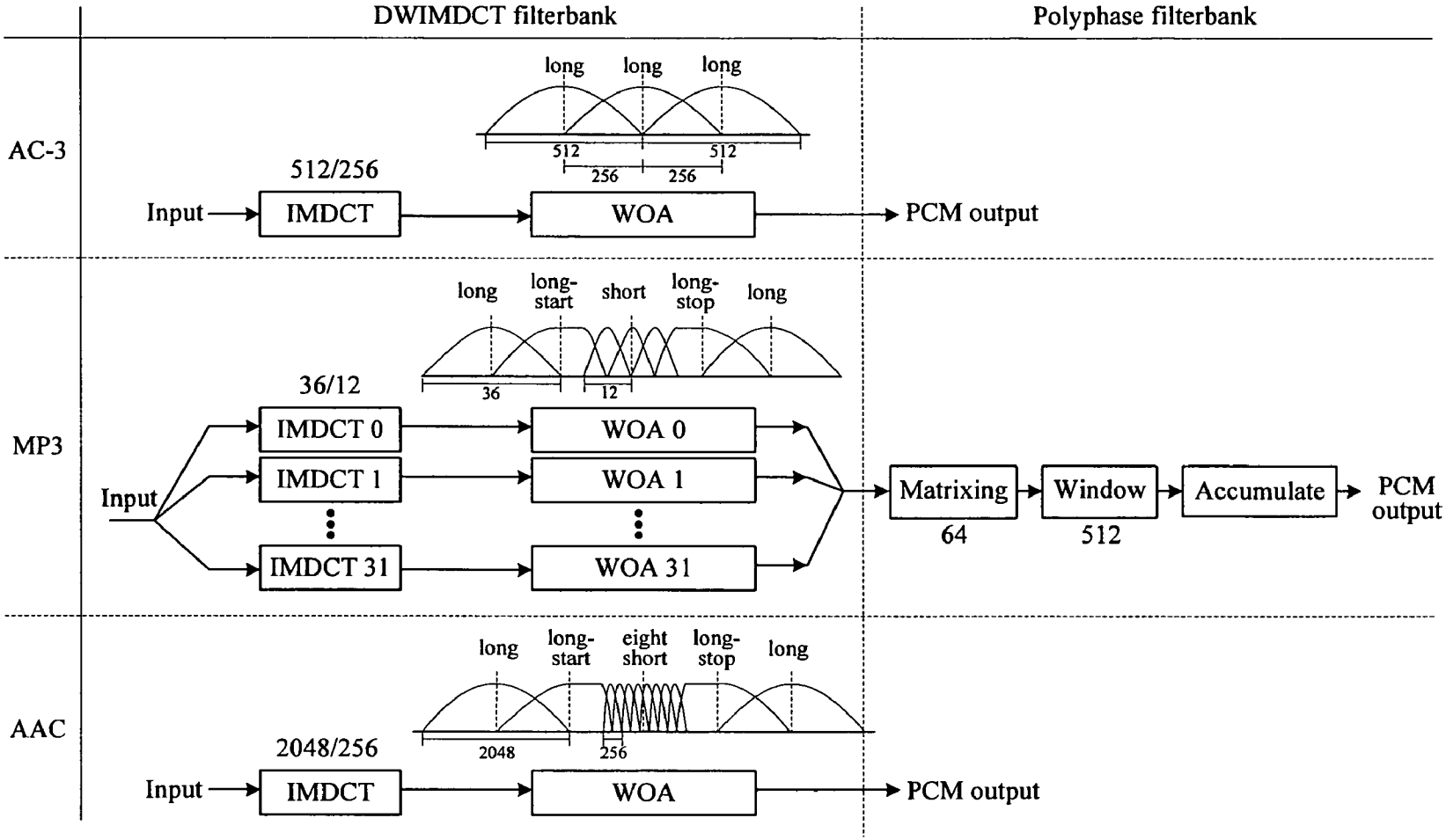
FIG. 1 is a flow chart of a decoding process of an AC-3, MP3 or AAC filterbank processor in accordance with the present invention.

Referring to FIG. 1 for a flow chart of decoding processes of AC-3, MP3 and AAC filterbank processors, all of the three audio compression standards include inverse modified discrete cosine transform (IMDCT) and window and overlap-add (WOA) decoding operations. After the MP3 completes the aforementioned operation, the decoding process further includes a matrixing decoding operation multiplied by a window coefficient and accumulated.

Figure 2A:
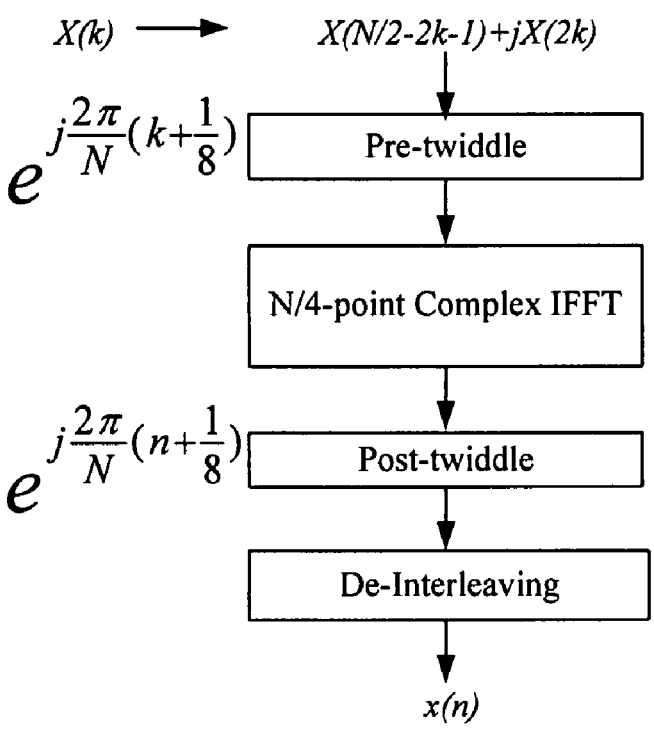
FIG. 2*a* is a flow chart of using an inverse fast Fourier transform (IFFT) algorithm to replace an inverse modified discrete cosine transform (IMDCT) decoding operation in accordance with the present invention.
Figure 2B:
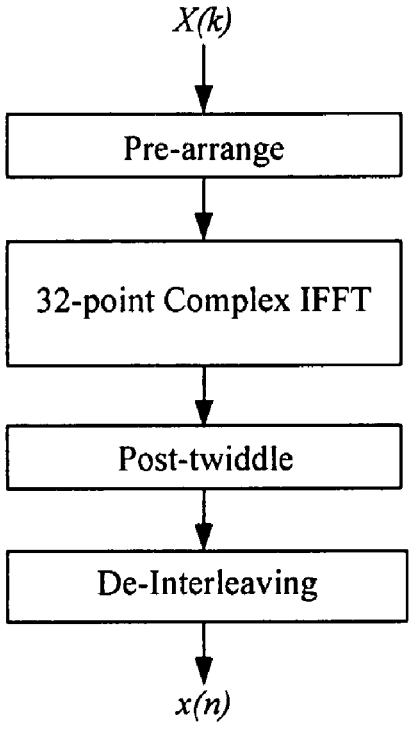
FIG. 2*b* is a flow chart of using an inverse fast Fourier transform (IFFT) algorithm to replace a matrixing decoding operation in accordance with the present invention.
Figure 3A:
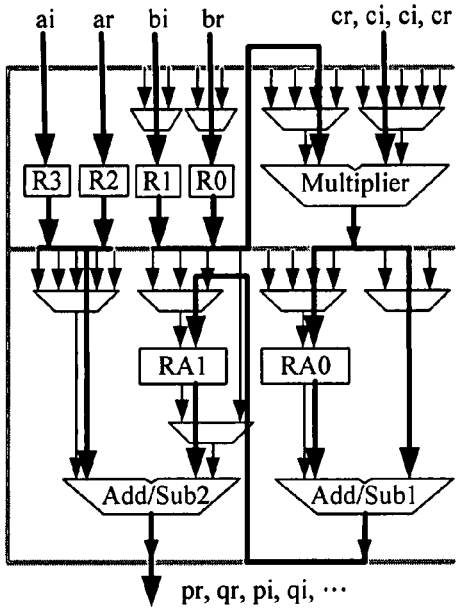
FIG. 3*a* is a flow chart of a hardware architecture configuration and a data computation of an even point inverse fast Fourier transform (IFFT) mode in accordance with the present invention.
Figure 3B:
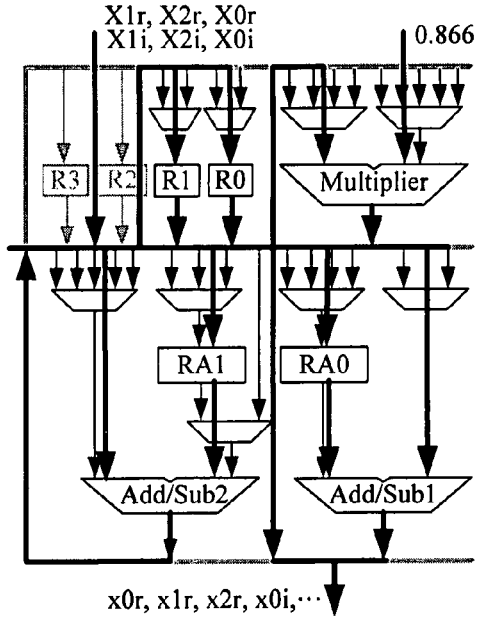
FIG. 3*b* is a flow chart of a hardware architecture configuration and a data computation of an odd point inverse fast Fourier transform (IFFT) mode in accordance with the present invention.
Figure 3C:
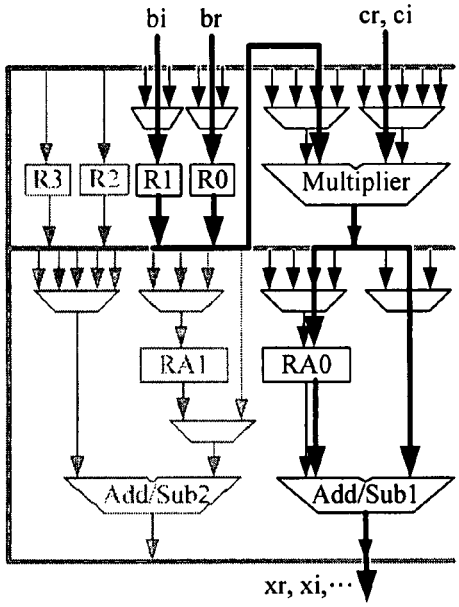
FIG. 3*c* is a flow chart of a hardware architecture configuration and a data computation of a pre/post-twiddle mode in accordance with the present invention.
Figure 3D:
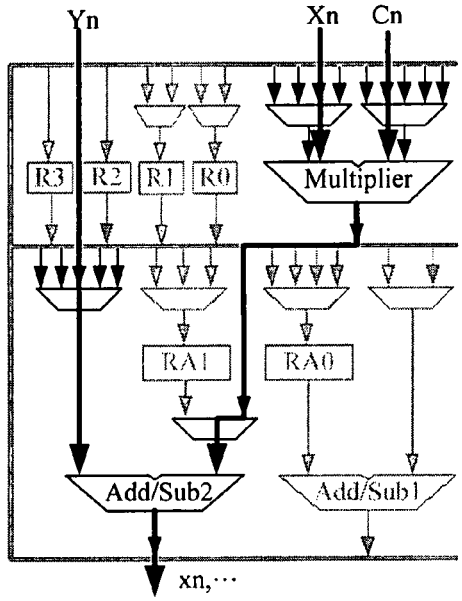
FIG. 3*d* is a flow chart of a hardware architecture configuration and a data computation of an overlap-add (WOA) mode in accordance with the present invention.

Since the inverse modified discrete cosine transform (IMDCT) and matrixing decoding operations are very complicated, the flow chart of using a different inversed fast Fourier transform (IFFT) algorithm to replace the inverse modified discrete cosine transform (IMDCT) and the matrixing decoding operation as shown in FIGS. 2*a* and 2*b* respectively are described below:

FIG. 2*a* shows a flow chart of an inverse fast Fourier transform (IFFT) algorithm that replaces the inverse modified discrete cosine transform (IMDCT) decoding operation, and the procedure comprises the steps of:

decomposing an inputted coefficient into odd points and even points to form a series;

multiplying the series with a pre-twiddle coefficient factor, and perform an inverse fast Fourier transform (IFFT) for N/4 points, wherein N is the length of the inputted data; and multiplying the result of the inverse fast Fourier transform (IFFT) with a post-twiddle coefficient factor, and rearranging the sequence to correspond to a correct output.

FIG. 2*b* shows a flow chart of an inverse fast Fourier transform (IFFT) algorithm that replaces the matrixing decoding operation, and the procedure comprises the steps of:

rearranging the sequence of the inputted coefficients to form a series;

performing an inverse fast Fourier transform (IFFT) for 32 points of the series; and multiplying the result of the inverse fast Fourier transform (IFFT) with a post-twiddle coefficient factor, and rearranging the sequence to correspond to a correct output.

After the inverse modified discrete cosine transform (IMDCT) and matrixing decoding operations are completed, the present invention divides the operations required by the filterbank processor of the three audio compression standards into four operation modes. Referring to FIGS. 3*a* to 3*d* for the flow chart of a hardware architecture configuration and a data computation of four independent operation modes in accordance with the present invention, the four operation modes include a first mode: an even point inverse fast Fourier transform (IFFT), a second mode: an odd point inverse fast Fourier transform (IFFT), a third mode: a pre/post-twiddle and a fourth mode: an overlap-add (WOA).

In FIGS. 3*a* to 3*d*, the hardware architecture of a filterbank processor comprises:

a plurality of multiplexers, for receiving an inputted signal of three audio compression standards, respectively MP3, AC-3 and AAC, to select different operation modes and reconfigure the hardware;

a plurality of registers, for storing signals selected by the multiplexers, wherein the signals are variables required for computing the pipeline architecture of an even point inverse fast Fourier transform (IFFT) and an odd point inverse fast Fourier transform (IFFT);

a multiplier, for performing a multiplication to a signal processed by the multiplexers and the registers; and two adders/subtractors, for performing an addition or a subtraction to a result stored in a memory and outputting the final result, wherein the present invention can be used universally for the computation of the aforementioned four modes by the same hardware architecture to reduce the hardware cost of the decoder.

Figure 4A:
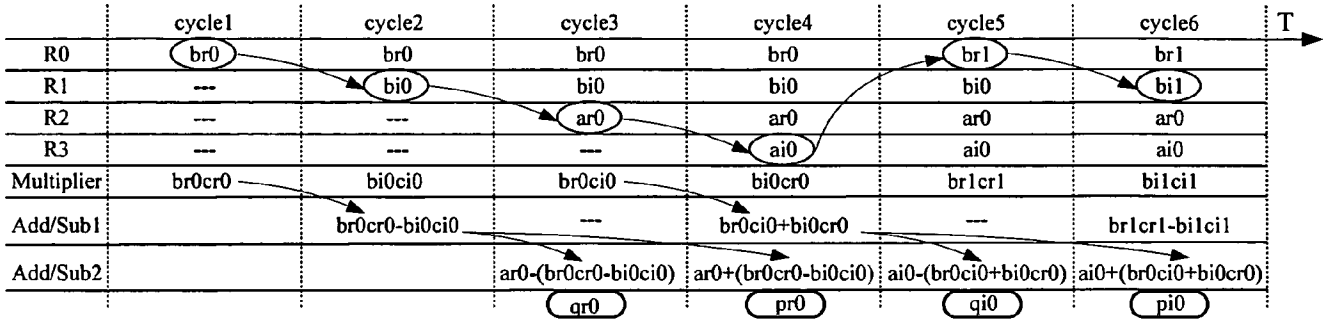
FIG. 4*a* is a timing chart of an even point inverse fast Fourier transform (IFFT) pipeline process in accordance with the present invention.
Figure 4B:
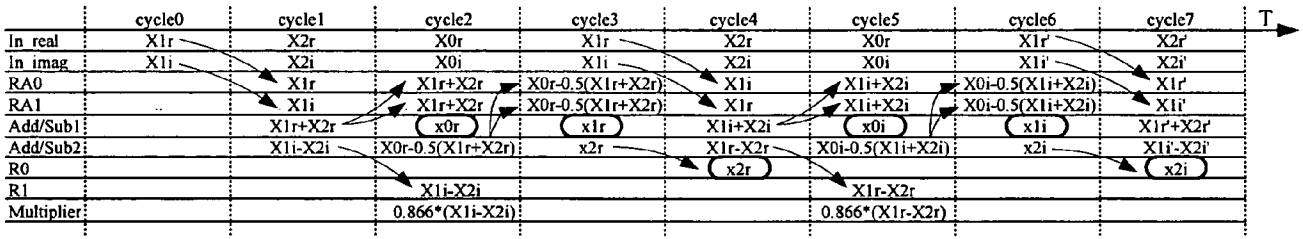
FIG. 4*b* is a timing chart of an odd point inverse fast Fourier transform (IFFT) pipeline process in accordance with the present invention.
Figure 4C:
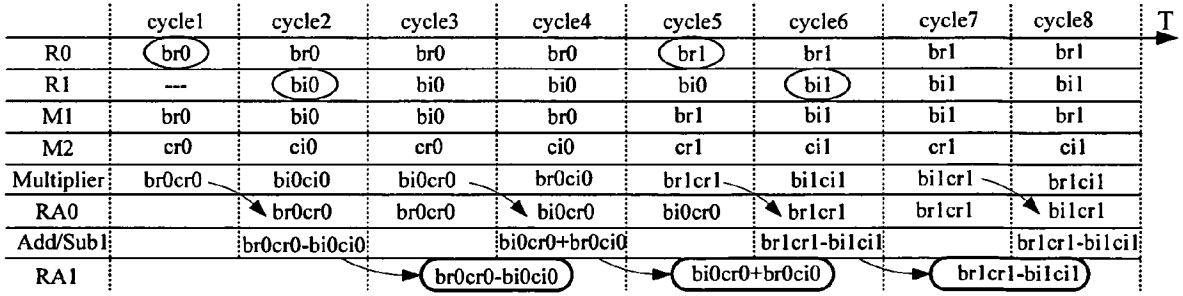
FIG. 4*c* is a timing chart of a pre/post-twiddle pipeline process of the present invention.

Referring to FIGS. 4*a* to 4*c* for the timing charts of a pipeline process of a corresponding operation mode in accordance with the present invention, the pipeline hardware design is used for greatly reducing the computation time, and improving the overall efficiency of the decoder. FIG. 4*a* shows a flow chart of a pipeline procedure of an even point inverse fast Fourier transform (IFFT), and the procedure comprises the following steps:

(1) The first cycle inputs a real part br0 of a first point, while multiplying a real part cr0 of a first coefficient, which equals to (br0cr0).

(2) The second cycle inputs an imaginary part bi0 of the first point, while multiplying an imaginary part ci0 of the first coefficient, which equals to (bi0ci0), and subtracting the current value from the value outputted from Step (1), which equals to (br0cr0−bi0ci0).

(3) The third cycle produces the real part br0 of the first point and multiplies the imaginary part ci0 of the first coefficient, which equals to (br0ci0), while inputting the real part ar0 of the second point, and then subtracting the result of Step (2) to produce an output of the real part of the second point, which equals to (ar0−(br0cr0−bi0ci0)).

(4) The fourth cycle produces the imaginary part bi0 of the first point and multiplies the real part cr0 of the first coefficient, which equals to (bi0cr0), and adds (br0ci0) produced in Step (3), while inputting the imaginary part ai0 of the second point, and then adding the result of Step (2) to the real part ar0 of the second point to produce an output of the real part of the first point, which equals to (ar0+(br0cr0−bi0ci0)).

(5) The fifth cycle inputs a real part br1 of a third point and multiplies a real part cr1 of a second coefficient, which equals to (br1cr1), and then subtracts (br0ci0+bi0cr0) produced by Step (4) from an imaginary part ai0 of the second point to obtain an imaginary part (ai0−(br0ci0+bi0cr0)) outputted from the second point.

(6) The sixth cycle inputs an imaginary part bi1 of the third point and multiplies an imaginary part ci1 of the second coefficient, which equals to (bi1ci1), and then subtracts the current value from the value outputted by Step (5), which equals to (br1cr1−bi1ci1), and then adds (br0ci0+bi0cr0) produced by Step (4) to the imaginary part ai0 of the second point to obtain the imaginary part outputted from the first point, which equals to (ai0+(br0ci0+bi0cr0)).

(7) This step repeats the foregoing steps until the computation result is produced, and the even point inverse fast Fourier transform (IFFT) is achieved by a radix-2 butterfly architecture.

FIG. 4*b* shows a flow chart of a pipeline procedure of an odd point inverse fast Fourier transform (IFFT), and the procedure comprises the following steps:

(1) The first cycle inputs a real part X1*r* and an imaginary part X1*i* of the second point.

(2) The second cycle inputs a real part X2*r* and an imaginary part X21 of the third point, while producing the real part X1*r* of the second point, adding the real part X2*r* of the third point, and the imaginary part X1*i* of the second point, and subtracting the imaginary part X21 of the third point.

(3) The third cycle inputs a real part X0*r* and an imaginary part X0*i* of the first point, while producing (the real part X0*r* of first point minus 0.5 times (the real part X1*r* of the second point plus the real part X2*r* of the third point)), 0.866 times (the imaginary part X1*i* of the second point minus the imaginary part X21 of the third point) and the outputted first point real part x0*r*.

(4) The fourth cycle inputs the real part X1*r* and the imaginary part X1*i* of the second point, while producing the real part x1*r* of the second point and the real part x2*r* of the third point.

(5) The fifth cycle outputs the real part X2*r* and the imaginary part X21 of the third point, while producing the imaginary part X1*i* of the second point plus the imaginary part X21 of the third point and the real part X1*r* of the second point minus the real part X2*r* of the third point.

(6) The sixth cycle outputs the real part X0*r* and the imaginary part X0*i* of the first point, while producing (the imaginary part X0*i* of the first point minus 0.5 times (the imaginary part X1*i* of the second point plus the imaginary part X21 of the third point)), 0.866 times (the real part X1*r* of the second point minus the real part X2*r* of the third point) and the outputted imaginary part x0*i* of the first point.

(7) The seventh cycle outputs the real part X1*r*' and the imaginary part X1*i*' of the fifth point, while producing the imaginary part x1*i* of the second point and the imaginary part x21 of the third point.

(8) This steps the foregoing steps until the computation result is produced, and the odd point inverse fast Fourier transform (IFFT) is achieved by a radix-2 butterfly architecture derived from a radix-3 algorithm.

Figure 5:
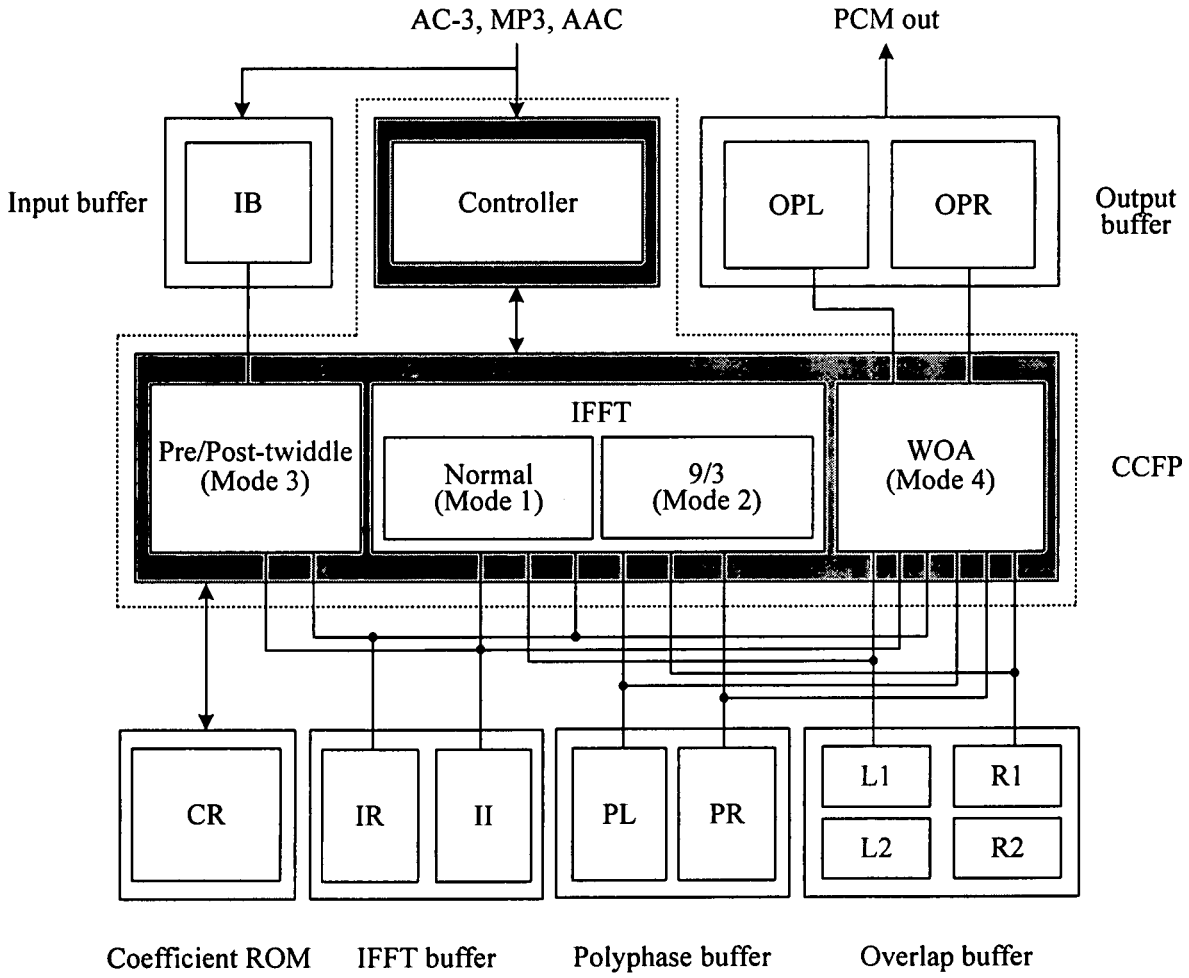
FIG. 5 is a schematic view of an overall architecture of the present invention.

Referring to FIG. 5 for a schematic view of an overall architecture of the present invention, the signal is stored in an input buffer (IB) 2 after the AC-3, MP3 or AAC signal is inputted. After the configurable common filterbank processor (CCFP) 1 of the invention executes the decoding operation required by the three audio standards, the result is stored into an output buffer 7, wherein the output buffer 7 includes a left channel (OPL) and a right channel (OPR), and finally produces a pulse code modulation (PCM) output. The coefficient ROM (CR) 3 in the figure is used for storing a constant coefficient required by the pre/post-twiddle, wherein the inverse fast Fourier transform (IFFT) buffer 4 is divided into an inverse fast Fourier transform real part (IR) and an inverse fast Fourier transform imaginary part (II), for storing data of inverse fast Fourier transform (IFFT) real number and imaginary number operations respectively, and the polyphase buffer 5 is divided into a left channel (PL) and a right channel (PR), and the overlap buffer 6 is divided into two left channels (L1, L2) and two right channels (R1, R2), and the overall architecture can be used universally for decoding the three audio compression standards: AC-3, MP3 and AAC respectively.

Figure 6:
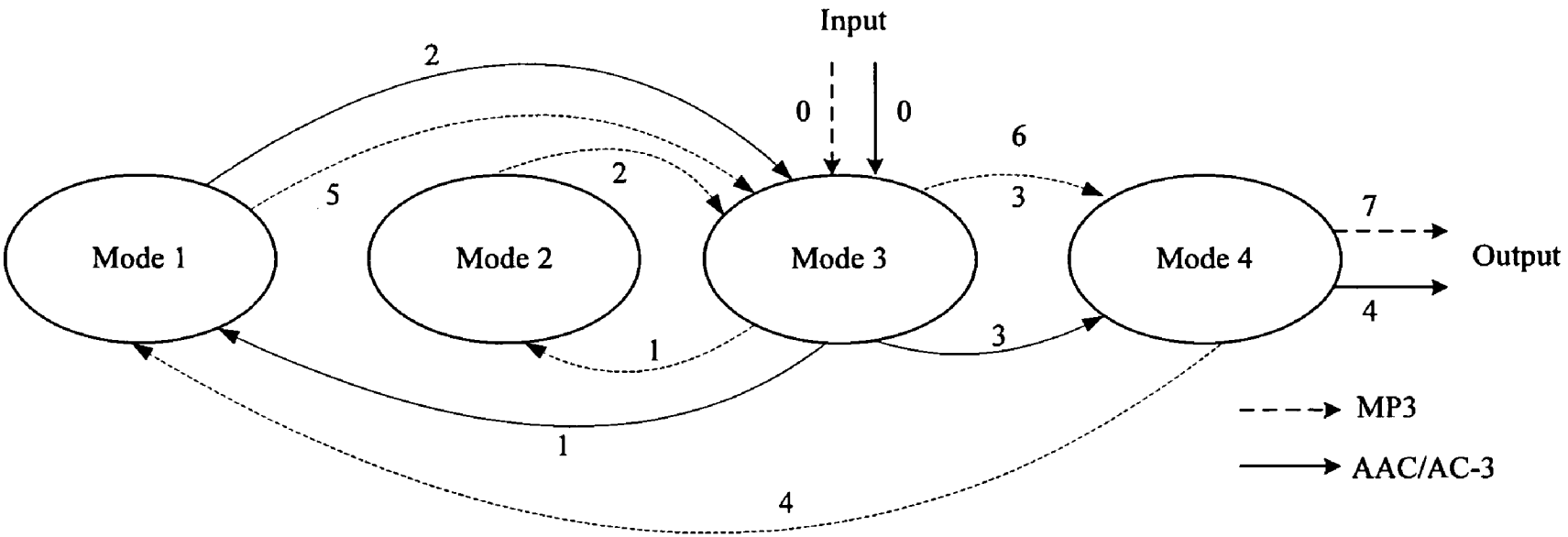
FIG. 6 is a flow chart of controlling an AC-3, MP3 or AAC filterbank processor of the present invention.

Referring to FIG. 6 for a flow chart of controlling a filterbank processor of AC-3, MP3 or AAC in accordance with the present invention, the procedure of the MP3 decoding operation includes the steps of inputting a signal→Mode 3→Mode 2→Mode 3→Mode 4→Mode 1→Mode 3→Mode 4; and the procedure of the AC-3 and AAC decoding operation includes the steps of inputting a signal→Mode 3→Mode 1→Mode 3→Mode 4.

Figure 7:
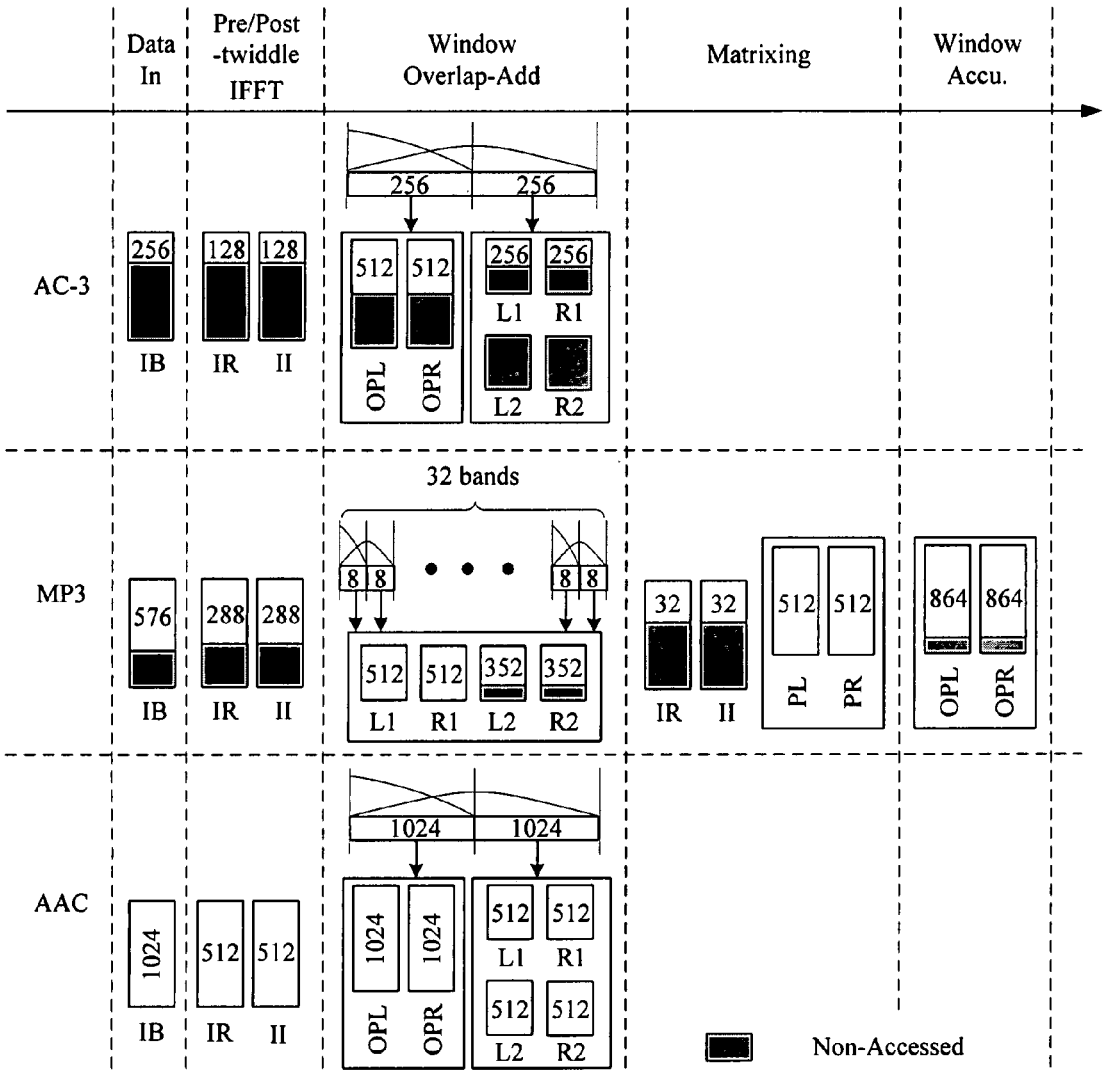
FIG. 7 shows a memory access in accordance with the present invention.

Referring to FIG. 7 for a memory access in accordance with the present invention, the memory required by the invention includes a memory for storing data from a single port with a size of 1024×24; a memory for storing data from two dual ports with a size of 512×24 for the inverse fast Fourier transform (IFFT) computation; a memory for storing data from four single ports with a size of 512×24 for the overlap computation data; a memory for storing data from two single ports with a size of 512×24 for the polyphase computation; and a memory for outputting data from two dual ports with a size of 1024×16. Further, a coefficient ROM of $4.4\times10^3$ words is required for storing a constant coefficient required by the pre/post-twiddle.

The number of cycles and the real-time operation frequency applied for the AC-3, AAC and MP3 in accordance with the present invention are shown in Table 2. The table indicates that the required real-time operation frequency is very low, even if the sampling frequency of the highest specification of each standard is achieved, and the AC-3, AAC and MP3 only require 1.3 MHz, 3 MHz and 3.6 MHz respectively. Obviously, the architecture of the invention is very efficient.

TABLE 2

Required Number of Cycles and Real-Time Operation Frequency

| Filterbank Processor | Decoding Procedure | No. of Cycles | Real-Time Operation Frequency |
|---|---|---|---|
| AC-3 | Pre/Post-Twiddle | 1,024 | 1.3 MHz* |
| | 128-Point IFFT | 1,792 | |
| | WOA | 512 | |
| | Total | 3,328 | |
| AAC | Pre/Post-Twiddle | 4,096 | 3 MHz** |
| | 512-Point IFFT | 9,216 | |
| | WOA | 2,048 | |
| | Total | 15,360 | |
| MP3 | IMDCT of Dynamic Window Switching | | 3.6 MHz* |
| | Pre/Post-Twiddle | 2,304 | |
| | IFFT | 1,664 | |
| | WOA | 1,184 | |
| | Polyphase | | |
| | IFFT | 5,760 | |
| | Post-Twiddle | 1,206 | |
| | WOA | 9,234 | |
| | Total | 21,352 | |

*Sampling Frequency = 8 KHz;
**Sampling Frequency = 96 KHz.

Compared with the prior arts, the configurable common filterbank processor applicable for various audio standards 1 and its processing method in accordance with the present invention have the following advantages:

1. The invention provides an architecture of a filterbank processor applicable for the AC-3, MP3 or AAC audio decoder to solve the problem of the most complicated unit in each audio standard, and the defined filterbank processor architecture has a wider scope of application than the prior art.

2. The invention analyzes all conversion programs and derives a quick algorithm, and uses the similarity of different audio standards to achieve the effects of sharing hardware, implementing a dedicated hardware for processing all filterbank processors, and greatly reducing power consumption, computation, and the using quantity of memories.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A configurable common filterbank processor (CCFP) applicable for various audio standards, comprising:

a plurality of multiplexers, for receiving an inputted signal of three audio compression standards respectively MP3, AC-3 and AAC, and selecting different operation modes and reconfiguring hardware;

a plurality of registers, for storing a signal selected by the multiplexers;

a multiplier, for performing a multiplication to the signal processed by the multiplexers and the registers;

two adders/subtractors, for performing an addition or a subtraction to a result stored in the memories, and outputting the result.

2. The configurable common filterbank processor (CCFP) applicable for various audio standards as recited in claim 1, wherein the signal stored in the registers is a variable required for the computation of an even point inverse fast Fourier transform (IFFT) and an odd point inverse fast Fourier transform (IFFT) pipeline architecture.

3. The configurable common filterbank processor (CCFP) applicable for various audio standards as recited in claim 1, wherein the memories further comprise:

an input memory, having at least one single port, for storing the inputted signal;

a memory, having at least two dual ports, for storing data for an inverse fast Fourier transform (IFFT) computation;

a memory, having at least four single ports, for storing data for an overlap computation;

a memory, having at least two single ports, for storing data for a polyphase computation;

an output memory, having at least two dual ports, for storing a computation result; and at least one coefficient ROM of $4.4\times10^3$ words, for storing a constant coefficient required by a pre/post-twiddle.

4. A processing method of a configurable common filterbank processor (CCFP) applicable for various audio standards, comprising:

dividing inverse modified discrete cosine transform (IMDCT), overlap-add (WOA) and matrixing decoding operations into a plurality of operation modes;

replacing the inverse modified discrete cosine transform (IMDCT) and matrixing decoding operations respectively by different inverse fast Fourier transform (IFFT) algorithms;

determining an operation mode according to an inputted parameter, and executing the decoding operation; and generating an pulse code modulation (PCM) output according to a result obtained from the decoding operation.

5. The processing method of a configurable common filterbank processor (CCFP) applicable for various audio standards as recited in claim 4, wherein the operation modes include a first mode: an even point inverse fast Fourier transform (IFFT), a second mode: an odd point inverse fast Fourier transform (IFFT), a third mode: pre/post-twiddle and a fourth mode: an overlap-add (WOA).

6. The processing method of a configurable common filterbank processor (CCFP) applicable for various audio standards as recited in claim 5, wherein the even point inverse fast Fourier transform (IFFT) uses a computation of a pipeline architecture, comprising the steps of:

(1) the first cycle inputting a real part br0 of a first point, while multiplying a real part cr0 of a first coefficient, which equals to (br0cr0);

(2) the second cycle inputting an imaginary part bi0 of the first point, while multiplying an imaginary part ci0 of the first coefficient, which equals to (bi0ci0), and then subtracting the current value from a value outputted from Step (1) to obtain (br0cr0−bi0ci0);

(3) the third cycle outputting the real part br0 of the first point, while multiplying the imaginary part ci0 of the first coefficient, which equals to (br0ci0), while inputting a real part ar0 of the second point, and then subtracting a result of Step (2) to produce an output of a real part of the second point, which equals to (ar0−(br0cr0−bi0ci0));

(4) the fourth cycle producing the imaginary part bi0 of the first point, multiplying the real part cr0 of the first coefficient, which equals to (bi0cr0), and adding (br0ci0) produced from Step (3), while inputting an imaginary part ai0 of the second point, and then adding the real part ar0 of the second point with a result of Step (2) to output a real part (ar0+(br0cr0−bi0ci0)) of the first point;

(5) the fifth cycle inputting the real part br1 of the third point, and multiplying the real part cr1 of the second coefficient, which equals to (br1cr1), and then subtracting (br0ci0+bi0cr0) produced from Step (4) from the imaginary part ai0 of the second point to obtain an imaginary part (ai0−(br0ci0+bi0cr0)) outputted from the second point;

(6) the sixth cycle inputting an imaginary part bi1 of the third point, and multiplying an imaginary part ci1 of the second coefficient, which equals to (bi1 ci1), and subtracting the current value from a value outputted from Step (5), which equals to (br1cr1−bi1ci1), and adding (br0ci0+bi0cr0) produced from Step (4) to the imaginary part ai0 of the second point to obtain an imaginary part (ai0+(br0ci0+bi0cr0)) outputted from the first point; and (7) repeating the aforementioned steps until a computation result is produced.

7. The processing method of a configurable common filterbank processor (CCFP) applicable for various audio standards as recited in claim 5, wherein the even point inverse fast Fourier transform (IFFT) is implemented by a radix-2 butterfly architecture.

8. The processing method of a configurable common filterbank processor (CCFP) applicable for various audio standards as recited in claim 5, wherein the odd point inverse fast Fourier transform (IFFT) adopts a pipeline architecture operation comprising the steps of:

(1) a first cycle inputting a real part X1*r* and an imaginary part X1*i* of a second point;

(2) a second cycle inputting a real part X2*r* and an imaginary part X2*i* of a third point, while producing a real part X1*r* of the second point plus a real part X2*r* of a third point and an imaginary part X1*i* of the second point minus an imaginary part X2*i* of the third point;

(3) the third cycle inputting a real part X0*r* and an imaginary part X0*i* of the first point, while producing (the real part X0*r* of the first point minus 0.5 times (the real part X1*r* of the second point plus the real part X2*r* of the third point)), 0.866 times (the imaginary part X1*i* of second point minus the imaginary part X2*i* of the third point) and the outputted real part x0*r* of the first point;

(4) a fourth cycle outputting the real part X1*r* and the imaginary part X1*i* of the second point, while producing the real part x1*r* of the second point and the real part x2*r* of the third point;

(5) the fifth cycle inputting the real part X2*r* and the imaginary part X2*i* of the third point, while producing the imaginary part X1*i* of the second point plus the imaginary part X2*i* of the third point and the real part X1*r* of the second point minus the real part X2*r* of the third point;

(6) the sixth cycle inputting the real part X0*r* and the imaginary part X0*i* of the first point, while producing (the imaginary part X0*i* of the first point minus 0.5 times (the imaginary part X1*i* of the second point plus the imaginary part X2*i* of the third point)), 0.866 times (the real part X1*r* of the second point minus the real part X2*r* of the third point) and an outputted imaginary part x0*i* of the first point;

(7) the seventh cycle outputting a real part X1*r*' and an imaginary part X1*i*' of a fifth point, while producing the imaginary part x1*i* of the second point and the imaginary part x2*i* of the third point; and (8) repeating the aforementioned steps until a computation result is produced.

9. The processing method of a configurable common filterbank processor (CCFP) applicable for various audio standards as recited in claim 5, wherein the odd point inverse fast Fourier transform (IFFT) is implemented by a radix-2 butterfly architecture derived from a radix-3 algorithm.

10. The processing method of a configurable common filterbank processor (CCFP) applicable for various audio standards as recited in claim 4, wherein the procedure of replacing the inverse fast Fourier transform (IFFT) algorithm of the inverse modified discrete cosine transform (IMDCT) comprises the steps of:

decomposing an inputted coefficient into odd points and even points to form a series;

multiplying the series with a pre-twiddle coefficient factor, and performing an inverse fast Fourier transform (IFFT) of N/4 points, wherein N is the length of an inputted data; and multiplying a result of the inverse fast Fourier transform (IFFT) with a post-twiddle coefficient factor, and corresponding to a correct output after rearranging the sequence.

11. The processing method of a configurable common filterbank processor (CCFP) applicable for various audio standards as recited in claim 4, wherein the procedure of replacing the inverse fast Fourier transform (IFFT) algorithm of the matrixing decoding operation comprises the steps of:

rearranging the sequence of inputted coefficients to form a series;

performing an inverse fast Fourier transform (IFFT) of 32 points of the series; and multiplying a result of the inverse fast Fourier transform (IFFT) with a post-twiddle coefficient factor, and corresponding to a correct output after rearranging the sequence.

* * * * *